US005944337A

United States Patent [19]

Girard et al.

[11] Patent Number: 5,944,337

[45] Date of Patent: Aug. 31, 1999

[54] AUTOMATIC BINDING DEVICE

[75] Inventors: Francois Girard, Veyrier Du Lac; Jacques Quellais, Saint-Jorioz, both of France

[73] Assignee: Salomom S.A., Metz-Tessy, France

[21] Appl. No.: 08/706,262

[22] Filed: Sep. 4, 1996

[30] Foreign Application Priority Data

Sep. 6, 1995 [FR] France ..... 95 10586

[51] Int. Cl.[6] ..... A63C 7/00

[52] U.S. Cl. ..... 280/615; 280/613

[58] Field of Search ..... 280/613, 615, 280/631, 632; 36/117.1, 117.2, 117.3

[56] References Cited

U.S. PATENT DOCUMENTS

| | | | |
|---|---|---|---|
| 4,722,613 | 2/1988 | Jungkind | 280/615 |
| 4,836,572 | 6/1989 | Pozzobon | 280/613 |
| 4,909,531 | 3/1990 | Graillat | 280/615 |
| 4,915,406 | 4/1990 | Graillat | 280/615 |
| 5,052,710 | 10/1991 | Provence et al. | 280/615 |
| 5,066,036 | 11/1991 | Broughton | 280/615 |
| 5,190,309 | 3/1993 | Spitaler et al. | 280/615 |
| 5,207,446 | 5/1993 | Arnulf et al. | 280/615 |
| 5,332,253 | 7/1994 | Couderc et al. | 280/602 |
| 5,513,872 | 5/1996 | Arduin et al. | 280/602 |
| 5,671,941 | 9/1997 | Girard | 280/615 |

FOREIGN PATENT DOCUMENTS

| | | | |
|---|---|---|---|
| 0530449 | 3/1993 | European Pat. Off. . | |
| 2439602 | 5/1980 | France . | |
| 2635014 | 2/1990 | France . | |
| 2642980 | 8/1990 | France | 280/615 |
| 3924915 | 2/1990 | Germany . | |
| 3935202 | 5/1990 | Germany | 280/615 |
| 4428154 | 3/1995 | Germany . | |
| 680047 | 6/1992 | Switzerland | 280/613 |
| 85/05557 | 12/1985 | WIPO | 280/615 |
| WO87/01296 | 3/1987 | WIPO . | |
| 94/09660 | 5/1994 | WIPO | 280/615 |

*Primary Examiner*—Christopher P. Ellis
*Assistant Examiner*—Frank Vanaman
*Attorney, Agent, or Firm*—Greenblum & Bernstein, P.L.C.

[57] ABSTRACT

A device for automatic binding of a sporting good on a corresponding boot representing an axial immobilization mechanism capable of cooperating with a corresponding notch arranged transversely on a binding body affixed to the sporting good and including an associated latch that can be activated from a latching position of the immobilization mechanism of the boot and vice versa, by way of a control device arranged on the binding body, and acting on the latch. The latching or unlatching control device of the latch are constituted by a knuckle joint type system acting on the immobilization mechanism of the boot and activated by one of the ends of the latter. The immobilization mechanism is arranged transversely in an intermediate zone of the sole of the boot, located between its two ends.

24 Claims, 3 Drawing Sheets

3
6b
6
6a
25
9
12
1
19
11
10
13
26
7
22
11a
27
O'
17
O
4
5
8
16
15
21
14
20
2

3
20
6b
8
17
5
27
26
6a
9
25
O
O''
4
7
16
15
22
21
19
14
11
1
12
13
2
10

AUTOMATIC BINDING DEVICE

BACKGROUND OF THE INVENTION

1. Field of the Invention

The present invention relates to an automatic device for binding a gliding member or any other sporting item on a corresponding boot, of the type allowing a certain possibility of pivoting of movement to the boot.

Thus, it can be a roller skate, roller blade, gliding board, telemark ski, bicycle pedal, or a cross-country ski.

2. Background and Material Information

In all of the aforementioned cases of known applications, and especially in the case of a cross-country ski, the boot has an axial immobilization means capable of cooperating with a housing or a corresponding notch arranged transversely on a body of the binding device affixed to the ski and comprising an associated latch that can be activated from a latching position of the immobilization means of the boot and vice versa, by means of control means arranged on the binding body, and acting on the latch.

An automatic binding device of this type, already known in cross-country skiing, includes a base in which a notch having a U-shaped section is provided, adapted to receive a journal axis of the boot, which extends transversely to the longitudinal axis of the ski, and whose upper portion is capable of being blocked by a latch that can be displaced longitudinally. The latch is biased by a spring in the latching position, and the positioning of the boot in the binding must be done from top down by pushing back the latch to the open position. This boot is therefore positioned against the force of the spring biasing the latch into the latching position and, therefore, requires the production of a substantial effort at an intensity that is at least equal to that of the latching force of the system.

The positioning of the boot in such a binding device is not easy because it must be accompanied by an effort that must have a sufficient longitudinal intensity component to push back the latch into an opening position in order to enable the engagement and then the latching of the journal axis into the notch. The opening of the binding device is done manually.

The French Patent No. 2 635 014 proposes a binding device that remedies these disadvantages, by describing a system in which the latch is opened when it is in the fitting position, so as to facilitate the positioning of the boot.

This is made possible by the aforementioned patent, by the fact that the latch is also rotationally displaceable in a vertical plane, and that means are provided to make it pivot upwardly in the fitting position of the binding, so as to clear the passage of the axis of the boot towards its housing, in order to facilitate the positioning thereof with respect to the binding. In such a binding, the unlatching is done manually.

Another problem arises when the journal axis of the boot or any other means for axial immobilization of the latter, is not located at the front end of the boot but in an intermediate zone thereof located between its two ends. Indeed, in such a case, the user must "put on the boot blindly", i.e., he or she must position the journal axis of the boot in the associated housing of the binding device without any vision of this housing and therefore by successive trials and errors. Furthermore, such a positioning of the journal axis makes it difficult to access an unlatching control always necessary in a binding of this type that is in fact semi-automatic (i.e., with automatic latching, but manual unlatching). However, the tendency in the binding systems of cross-country ski but also in other systems such as telemark ski, biking . . . , is to have the binding zone of the boot in an intermediate zone between its ends and generally in the articulation zone of the metatarsal bones, i.e., in a zone extending over approximately the first third of the length of the boot or of the foot. Moreover, the known binding devices of this type have a disadvantage of not allowing a possibility of automatic release of the latching in certain critical situations, during the practice of the sport. Of course, this situation is most often encountered during a fall.

Until now, especially in the case of a cross-country ski, the tendency has been to think that because of the great freedom of movement of the foot, which is in fact only maintained by the tip of the boot in the binding of the ski, the latter could not have a substantial incidence in the twisting of the skier's ankle in the case of a fall. However, this situation is different when the boot is maintained on the gliding member in a median zone of its sole especially as the gliding member is a ski that is capable of exerting a substantial torsional stress through the lever arm which it creates.

It is readily understood that this could have serious consequences on the ankle of the athlete.

French Patent No. 2 439 602, commonly owned herewith, proposes another type of ski binding device comprising:

- a hooking element connected to the boot and extending the latter in the direction of its longitudinal axis, the element having at least one arm transverse to the longitudinal axis of the boot and spaced from the end of the latter;
- a support element mounted on the ski and comprising a first support zone for the transverse arm of the element connected to the boot, the support zone allowing the pivoting of the arm over itself;
- a system for retaining the arm against the first support zone, this retention system comprising a frame journalled on a portion affixed to the ski, on the one hand, and a movable pressure member, journalled on the frame and having a second support zone for the transverse arm allowing the pivoting of the arm over itself, on the other hand, the second support zone being provided on the pressure member that is capable of moving between an inactive position in which it is distanced from the first support zone located on the support element an active position in which its own support zone is applied against the arm of the hooking element and biased in the direction of the support zone of the support element due to the tensioning of an elastic element thus assuring the application of the two support zones against the transverse arm.

In fact, the frame and the movable pressure member constitute a latching system of the knuckle joint type, the journal axis of the frame on the movable member being located between the support zone of the movable member and the journal axis of the frame on the ski, and being capable of moving on both sides of the dead center line connecting the support zone to the journal axis of the frame on the ski.

Although this device is satisfactory with respect to the functioning of the latching, it has nevertheless several disadvantages, starting precisely with the fact that this latching can not be done automatically but, on the contrary, it forces the skier to bend down to latch or unlatch his or her boot, and also with the fact that it is not compatible with a position of the axis of the boot beneath the latter.

In addition, as already mentioned in the previous case, an automatic unlatching is not provided, and the same torsional effect on the tip of the boot can occur, especially in the case of a ski then acting in the manner of a lever arm.

SUMMARY OF THE INVENTION

An object of the present invention is to remedy the above-mentioned various disadvantages and to provide an improved binding device with automatic fitting, and which is compatible with a position of the latching member of the boot behind the front end of the latter.

To this end, the invention is directed to a device for automatic binding of a sporting item, on a corresponding boot representing an axial immobilization means or element capable of cooperating with a corresponding notch provided transversely on a binding body affixed to the sporting item and comprising an associated latch that can be activated from a latching position of the immobilization element of the boot and vice versa, by means of a control mechanism arranged on the binding body and acting on the latch, wherein the control mechanism for latching and unlatching the latch are constituted by a system of the knuckle joint type acting on the immobilization element of the boot, and wherein this knuckle joint type system is capable of being activated by one of the ends of the boot, and that the means is arranged transversely in an intermediate zone of a sole of the boot located between its two ends. Such an arrangement indeed makes it possible to use the lever arm available between advantageously the end of the boot and the immobilization element of the boot to exert the necessary closing force.

Preferably, and according to another characteristic of the invention, the immobilization element of the boot is arranged transversely on the sole in the zone of the metatarsal bones of a skier's foot, this arrangement being particularly advantageous for the practice of cross-country skiing (skating) and telemark or for biking.

BRIEF DESCRIPTION OF DRAWINGS

The present invention is also related to the characteristics that will become apparent along the description that follows, and which are to be considered separately or according to their possible technical combinations.

This description, provided by way of non-limiting example, will help to better understand how the invention can be embodied, with reference to the annexed drawings, and in which.

BRIEF DESCRIPTION OF THE PREFERRED EMBODIMENTS

Figure 1:
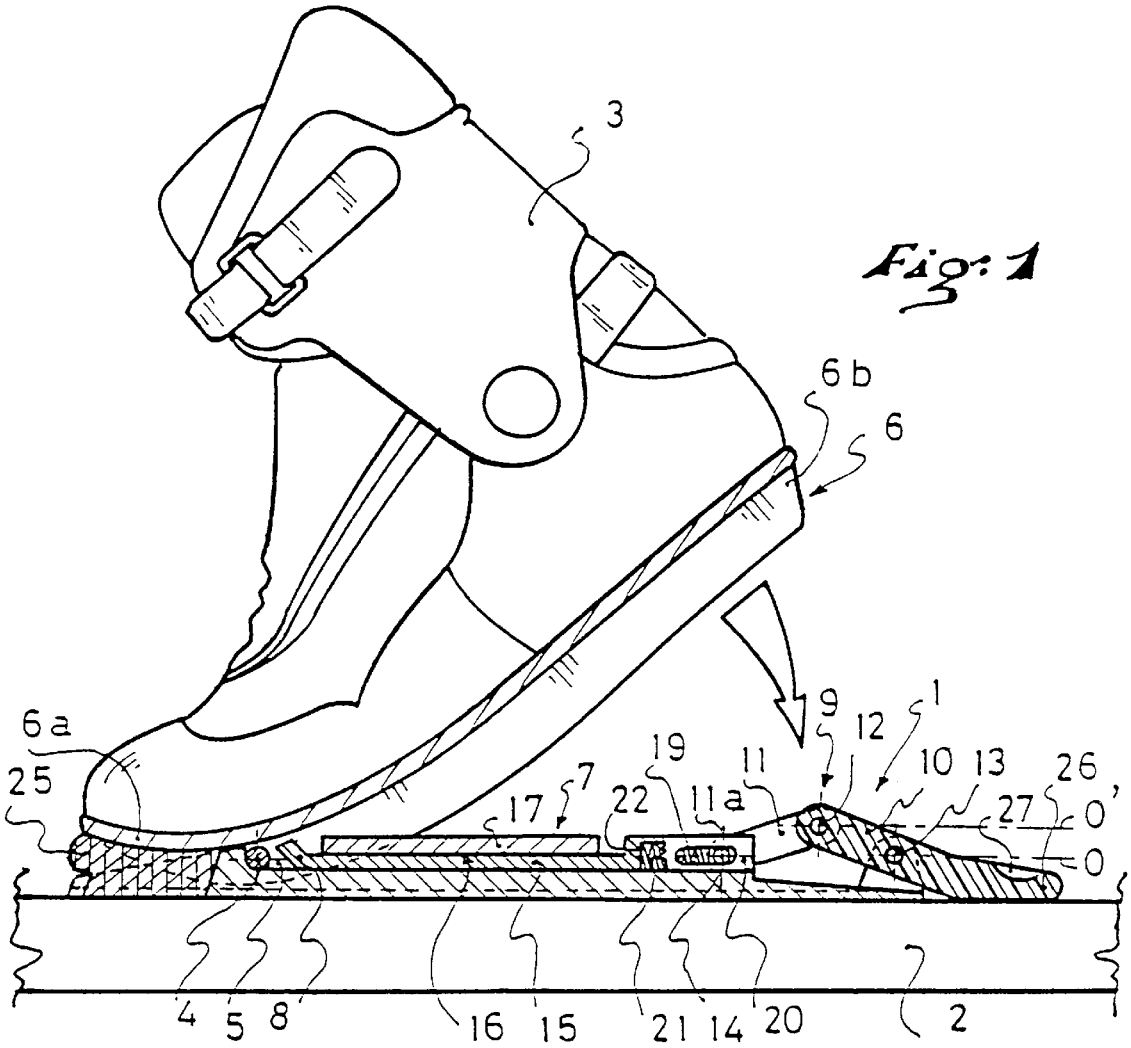
FIGS. 1 and 2 show views of a cross-country ski boot associated with a binding device according to the invention, in a longitudinal cross-sectional view, during latching and after latching, respectively.

The device 1 generally designated in FIGS. 1–5 is, according to the present selected example of application, intended for the automatic binding of a corresponding boot 3 on a cross-country ski 2. This device will be designated by the same reference numerals in the various views shown in FIGS. 1–5, with a suffix A for the similar elements in FIGS. 3–5 (See FIGS. 1 and 2).

The binding of the boot is accomplished by means of an axial immobilization element 4 or 4A (See FIGS. 3–5) affixed to the boot 3 and arranged in a front zone of its sole 6.

The immobilization element 4 or 4A has a section such that it is rendered capable of cooperating with a complementary immobilization element, in this case a corresponding notch 5 (See FIGS. 1 and 2), or 5A (FIGS. 3–5), provided transversely on a binding body 7 or 7A affixed to the ski 2, and comprising an associated latch 8 or 8A, that can be activated from a latching position (FIGS. 2 or 4) to an unlatching position (FIGS. 1 or 3) of the immobilization element 4 or 4A, or vice versa.

In the case shown in the figures of the drawing, the axial immobilization element 4, 4A, is constituted by a transverse rod having a circular section. It could also be a transverse bar having a rectangular or square section, or a hook, the complementary immobilization element provided on the sporting item then having complementary shapes.

Figure 3:
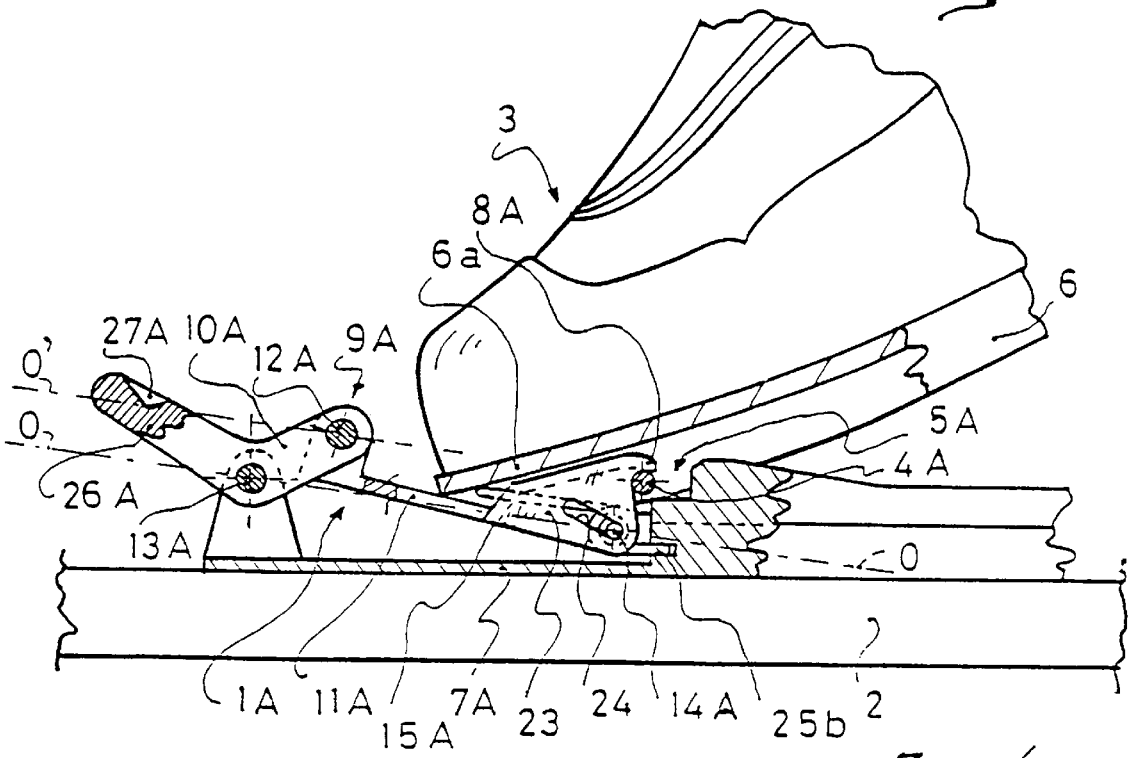
FIGS. 3 and 4 show views of a cross-country ski boot associated with a binding device according to an alternative embodiment of the invention, in a partial longitudinal cross-sectional view, during latching and after latching, respectively.

It must be noted that if FIGS. 1 and 3 show an unlatching position of the boot, they also show a positioning of the latter on the binding body 7 or 7A, in view of its latching.

These changes of positions are made by means of a control mechanism 9 or 9A arranged on the binding body 7, 7A, and acting on the latch 8, 8A.

According to the invention, the latching or unlatching control mechanism 9, 9A, of the latch 8, 8A, are constituted by a knuckle joint type system acting on the immobilization element 4, 4A, of the boot and activated by one of the ends 6*a* and 6*b* of the latter, and the immobilization is arranged transversely in an intermediate zone of the sole 6 of the boot 3, located between its two ends 6*a*, 6*b*.

The present invention also offers a particularly advantageous interest by arranging this immobilization element 4 transversely on the sole 6 in the zone of the metatarsal bones of a skier's foot. Indeed, such an arrangement tends to improve the control and the stability of the ski, while maintaining a possibility of rotation movement of the foot with respect to the latter, and makes it possible to extend the use of such a binding device to other sports such as biking, and especially to other gliding sports such as skating (roller blade, roller skating, ice skating), surfing, Telemark skiing. In the present case, the zone of the metatarsal bones is the zone located in the first third of the length of the foot and extends up to the metatarsophalangeal articulation zone.

In a general manner, common to the two embodiments shown in the drawings, the knuckle joint system 9, 9A is composed of two connecting rods 10 and 11, or 10A and 11A, journalled to one another at one of their end by a common journal axis 12, 12A, constituting a central point, the other ends of the connecting rods 10 and 11, or 10 and 11A, being journalled for one, on a fixed journal 13, 13A, affixed to the ski 2 located in a corresponding zone of the end 6*a*, 6*b*, of the boot 3, and for the other, on the journal 14, 14A, axially opposing the previous one and affixed to an element 15, 15A, movable longitudinally with respect to the ski 2, and including at its free end a portion forming the latch 8, 8A, capable of cooperating with the notch 5, 5A, of the binding body 7, 7A, to insure the positioning, then the latching of the axial immobilization element 4, 4A, of the boot 3.

This is done by causing the journal central point 12, 12A, to move from a position O' located above a neutral equilibrium line O passing through the two end journals 13, 14, of the connecting rods 10 and 11, or 10A and 11A, to a position O" located beneath this line O, this position O" corresponding to a stable and locked position of the knuckle joint system.

Figure 2:
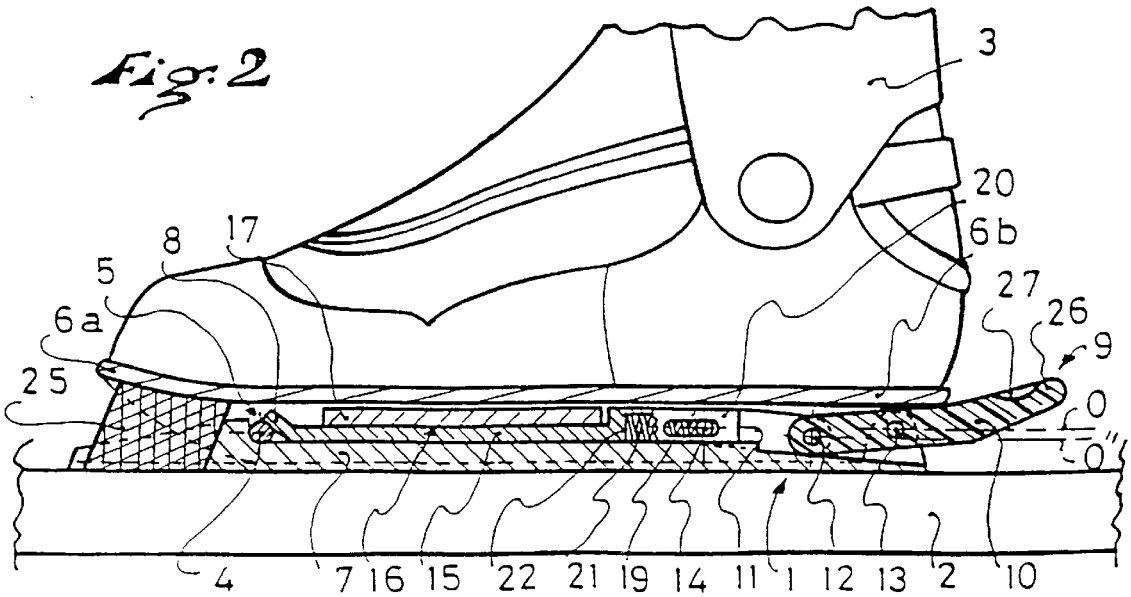

According to another characteristic of the invention and more particularly according the example of FIGS. 1 and 2, the knuckle joint 9 is arranged at the rear of the boot and the passage of the journal central point 12 from one position O' located above the equilibrium line O of the connecting rods 10 and 11, to a position O" located beneath the latter, i.e., the closure of the knuckle joint, is done by an action on the connecting rod 10 journalled on the fixed journal 13 affixed the ski 3, exerted by means of the heel 6*b* and of the sole 6 of the boot 3, this action being exerted first in the zone of the journal central point 12, then on the entire connecting rod 10, the axial immobilization element 4 of the boot 3 being first positioned in the notch 5A of the binding body 7 in view of a latching operation.

More specifically, the element 15 that is movable longitudinally and forms the latch 8 is constituted by the tie rod activated by the free end 11*a* of one of the connecting rods 11 of the knuckle joint 9 and slidably mounted in an equally longitudinal corresponding housing 16 defined between an upper zone of the binding body 7 and a lower zone of a support element 17 of the sole 6 of the boot 3, attached on the ski 2.

According to another characteristic, the connection between the longitudinally movable element 15 forming the latch 8 and the corresponding connecting rod 11 of the knuckle joint 9 is done by means of a slot 19 provided in a heel 20 of the movable element 15 and which is transversely crossed by the journal 14 of the connecting rod 11.

In addition, an elastic member 21 is interposed between the journal 14 and a shoulder 22 of the heel 20 so as to allow for a backward movement of the latch 8 beyond a predetermined effort dependent upon the force of the elastic member to ensure an automatic unlatching if necessary.

In fact, the end of the longitudinally movable element 15 forming the latch 8 is constituted by a portion that is upwardly angularly curved to demarcate, with the notch 5 of the binding body 7, a housing capable of receiving and of latching the immobilization element 4 of the boot 3 or, on the contrary, of enabling its release, according to a selected position of the knuckle joint 9.

Figure 4:
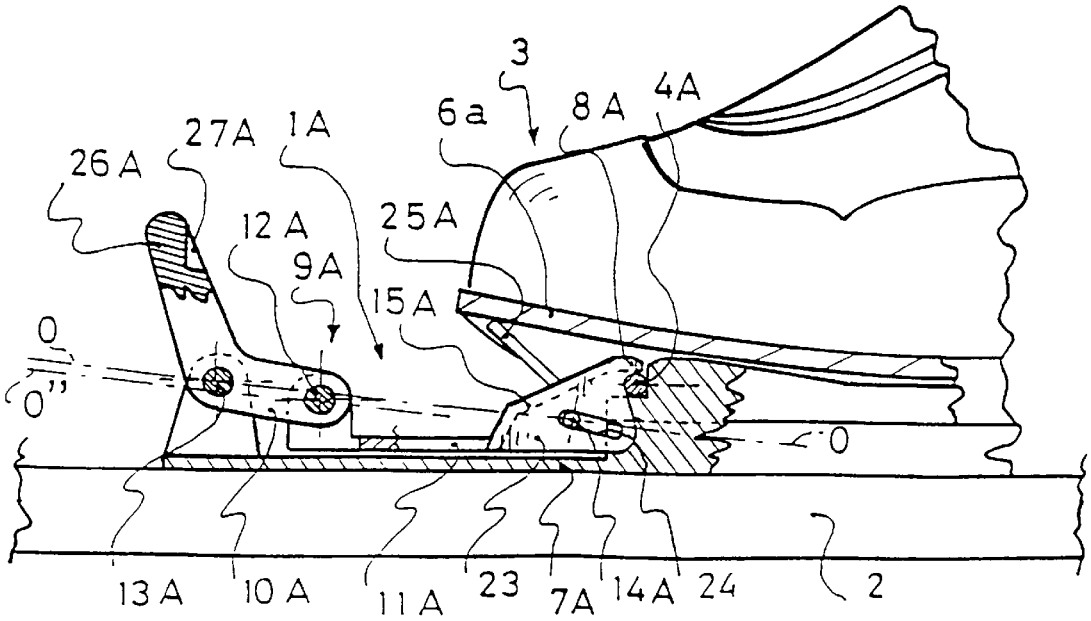
Figure 5:
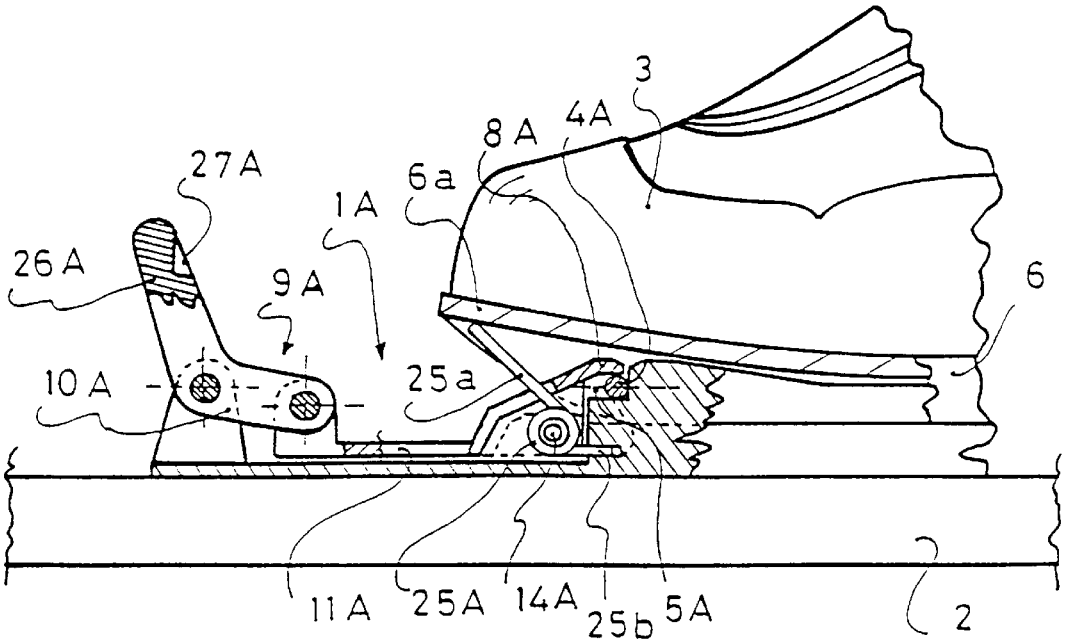
FIG. 5 is a longitudinal cross-sectional view in the latching position of the device according to FIG. 4.

According to the alternative embodiment shown in FIGS. 3, 4 and 5, the knuckle joint 9A of the device 1A essentially differs from the previous one in that it is arranged at the front end of the boot, and in that the passage of the journal central point 12A from a position O' located above the neutral equilibrium line O of the connecting rods 10A and 11A to a position O" located beneath the latter, i.e., the closure of the knuckle joint, is done by means of an action on the connecting rod 11A journalled on the journal 14A opposite the fixed journal 13A affixed to the ski 2, the action being exerted by means of the tip 6*a* of the sole 6 of the boot 3, the axial immobilization element 4A of the latter being first positioned in the notch 5A of the binding body 7A, in view of a latching operation.

In this case, the longitudinally movable element 15A is constituted by a cap formed of two lateral cheeks 23, arranged on both sides of the end of one 11A of the connecting rods of the knuckle joint 9A and each comprising guiding slots 24 obtained across from each other and constituting the journalled mounting of the connecting rod 11A with respect to the fixed journal 14A affixed to the binding body 7A.

Furthermore, the guiding and journal lateral cheeks 23 of the connecting rod 11A comprise, at their upper end, a portion that is curved like a hook, forming the latch 8A and demarcating with the notch 5 of the binding body 7A, a housing capable of receiving and latching the immobilization element 4A of the boot 3 or, on the contrary, of enabling its release, according to a selected position of the knuckle joint 9A.

According to these examples of embodiment, an elastic return member 25, 25A is inserted between the tip 6*a* of the sole 6 of the boot 3 and the binding body 7, 7A, at the front of the immobilization element 4, 4A, of the boot, so as to return the heel 6*b* of the latter towards the ski 2 when it is lifted, and to constitute, among others, a support for enabling the sensing of information regarding the positioning of the ski 2 in space and to improve the retention of the ski.

In fact, according to FIGS. 3, 4 and 5, the elastic return member is a hairpin spring 25A surrounding the journal 14A of the connecting rod 11A, and in which one of the free ends 25*a* takes support beneath the tip 6*a* of the sole 6, and in which the other end is housed in an appropriate cavity of the binding body 7A and which therefore biases the tip 6*a* of the sole upwardly.

According to the example of FIGS. 1 and 2, the elastic return member 25 is constituted by an elastomeric block that is elastically deformable in compression and is arranged between the upper surface of the ski and the lower surface of the tip 6*a* of the sole and which biases the latter upwardly.

According to another characteristic that is common to these two embodiments, the connecting rod 10, or 10A, journalled on the fixed journal 13, 13A affixed to the ski 2 is extended beyond this journal by a control lever 26, 26A extending freely beyond an end zone respectively 6*a*, 6*b* of the boot 3, and adapted to be activated downwardly, by any means, to cause the return of the journal central point 12, 12A from a position O" beneath the neutral equilibrium line O of the knuckle joint 9, 9A to a position O' above this line O, in view of the opening of the knuckle joint and of the unlatching of the immobilization element 4, 4A of the boot 3.

For example, the activating means can be constituted by the end of the ski pole which is housed in a notch 27 or 27A of the lever 26 or 26A, or by support on the latter with the other ski, or the boot itself if the ski is already removed, or by hand.

In all cases, the closure of the knuckle joint by means of an end (front or rear) of the boot is particularly advantageous and compatible with a positioning of the latching journal 4 between these two ends and especially at the level of the metatarsophalangeal articulation zone.

Although the invention has been described with reference to particular means, materials, and embodiments, it is to be understood that the invention is not limited to the particulars expressly disclosed, but the invention extends to all equivalents within the scope of the claims that follow.

What is claimed is:

1. A device for automatic binding of a sporting item to a boot by means of an axial immobilization element of a boot extending transversely of the boot in an intermediate zone between front and rear ends of the boot, while allowing a predetermined movement of the boot, the boot having a sole with an outer contour, said device comprising:

a binding body adapted to be secured to the sporting item;

a latch mounted on said binding body for selectively securing or releasing the boot with respect to the sporting item, said latch being mounted for movement on said binding body between a latching position, whereby the axial immobilization element of the boot is to be latched to said binding body, while allowing the predetermined movement of the boot, and an unlatching position, whereby the axial immobilization element of the boot is to be released from said binding body; and a control mechanism arranged on said binding body to control said movement of said latch between said latching position and said unlatching position, said control mechanism comprising a knuckle joint system, said knuckle joint system being positioned, with respect to said binding body, for engagement with one of the ends of the boot for moving said latch to said latching position;

said control mechanism further comprising a control member connected to said knuckle joint system for movement of said latch to said unlatching position, said control member extending sufficiently to extend beyond the outer contour of the sole of the boot.

2. A device according to claim 1, wherein:

a transversely extending notch is formed for receiving the immobilization element in said latching position of said latch, said notch being demarcated at least in part by a portion of said binding body, said notch being located with respect to said binding body to receive the immobilization element with the immobilization element being located on a sole of the boot in a zone corresponding to the metatarsal bones of a foot inserted within the boot.

3. A device according to claim 1, wherein:

an elastic return member is located in a position adapted to be below the front end of the boot and said binding body, forward of the immobilization element of the boot, to urge the rear end of the boot toward the sporting item in opposition to movement of the boot away from the sporting item.

4. A device according to claim 1, wherein:

a transversely extending notch is formed for receiving the immobilization element in said latching position of said latch, said notch being demarcated at least in part by a portion of said binding body;

said latch is formed by a free end of a longitudinally movable element mounted for longitudinal movement with respect to said binding body and adapted for longitudinal movement with respect to the sporting item for cooperation with said notch for receiving and latching the immobilization element of the boot;

said knuckle joint system comprises two longitudinally extending connecting rods journalled together at respective ends of said connecting rods, constituting an intermediate point of said knuckle joint system, said connecting rods having respective remote ends;

one of said remote ends of said connecting rods is fixedly journalled with respect to said binding body, by means of a journal connection, and adapted to be fixedly journalled with respect to the sporting item in a zone corresponding to one of the ends of the boot;

another of said remote ends of said connecting rods is journalled to said longitudinally movable element, by means of a journal connection, whereby movement of said immediate point of said knuckle joint from a position above a neutral equilibrium line passing through said journals of said remote ends of said connecting rods to a position below the neutral equilibrium line moves said latch to said latching position.

5. A device according to claim 4, wherein:

said intermediate point of said knuckle joint is located in a position adapted to be below a heel of a sole of the boot, whereby said movement of said intermediate point of said knuckle joint from a position above the neutral equilibrium line to a position below the neutral equilibrium line to move said latch to said latching position is caused automatically upon a lowering of the heel of the boot onto said intermediate point of said knuckle joint.

6. A device according to claim 4, wherein:

said binding body includes a longitudinally extending housing;

said longitudinally movable element forming said latch is constituted by a tie rod slidably mounted within said housing of said binding body, said tie rod being connected to one of said remote ends of said connecting rods of said knuckle joint system.

7. A device according to claim 4, wherein:

said journal connection between a remote end of one of said connecting rods and said longitudinally movable element comprises a slot provided in a rear of said longitudinally movable element;

a transversely extending journal rod, connected to said one of said connecting rods, extends through said slot;

an elastic member is interposed between said journal rod and a shoulder of said rear of said longitudinally movable element for allowing a backward movement of said latch beyond a predetermined extent to ensure an automatic unlatching.

8. A device according to claim 4, wherein:

said free end of said longitudinally movable element forming said latch is constituted by an upwardly curved portion to demarcate, with said notch of said binding body, a housing that receives and latches said immobilization element in said latching position of said latch and that allows release of said immobilization element in said unlatching position of said latch.

9. A device according to claim 4, wherein:

said journal connection between a remote end of one of said connecting rods and said longitudinally movable element is located in a position adapted to be below a front end of a sole of the boot, whereby said movement of said intermediate point of said knuckle joint from a position above the neutral equilibrium line to a position below the neutral equilibrium line to move said latch to said latching position is caused automatically by a force exerted by the front end of the sole of the boot to said journal connection below the front of the sole of the boot.

10. A device according to claim 4, wherein:

said longitudinally movable element comprises two laterally opposed cheeks arranged on opposite sides of an end of one of said connecting rods, each of said cheeks including a respective guiding slot aligned opposite the other check and constituting a mounting of said journal connection between a remote end of one of said connecting rods and said binding body.

11. A device according to claim 10, wherein:

said two laterally opposed cheeks of said longitudinally movable element is constituted by an upwardly curved portion forming said latch to demarcate, with said notch of said binding body, a housing that receives and latches said immobilization element in said latching position of said latch and that allows release of said immobilization element in said unlatching position of said latch.

12. A device for automatic binding of a sporting item to a boot by means of an axial immobilization element of a boot extending transversely of the boot in an intermediate zone between front and rear ends of the boot, while allowing a predetermined movement of the boot, said device comprising:

a binding body adapted to be secured to the sporting item;

a latch mounted on said binding body for selectively securing or releasing the boot with respect to the sporting item, said latch being mounted for movement on said binding body between a latching position, whereby the axial immobilization of the boot is to be latched to said binding body, while allowing the predetermined movement of the boot, and an unlatching position, whereby the axial immobilization element of the boot is to be released from said binding body;

a control mechanism arranged on said binding body to control said movement of said latch between said latching position and said unlatching position, said control mechanism comprising a knuckle joint system, said knuckle joint system being positioned, with respect to said binding body, for engagement with one of the ends of the boot for moving said latch to said latching position;

a transversely extending notch being formed for receiving the immobilization element in said latching position of said latch, said notch being demarcated at least in part by a portion of said binding body;

said latch being formed by a free end of a longitudinally movable element mounted for longitudinal movement with respect to said binding body and adapted for longitudinal movement with respect to the sporting item for cooperation with said notch for receiving and latching the immobilization element of the boot;

said knuckle joint system comprising two longitudinally extending connecting rods journalled together at respective ends of said connecting rods, constituting an intermediate point of said knuckle joint system, said connecting rods having respective remote ends;

one of said remote ends of said connecting rods being fixedly journalled with respect to said binding body, by means of a journal connection, and adapted to be fixedly journalled with respect to the sporting item in a zone corresponding to one of the ends of the boot;

another of said remote ends of said connecting rods being journalled to said longitudinally movable element, by means of a journal connection, whereby movement of said intermediate point of said knuckle joint from a position above a neutral equilibrium line passing through said journals of said remote ends of said connecting rods to a position below the neutral equilibrium line moves said latch to said latching position;

one of said connecting rods fixedly journalled with respect to said binding body extending beyond said journal connection by a control lever extending sufficiently to be adapted to extend beyond one of the ends of the boot, whereby movement of said control lever moves said intermediate point of said knuckle joint from a position below the neutral equilibrium line passing through said journals of said remote ends of said connecting rods to a position above the neutral equilibrium line to move said latch to said unlatching position.

13. A boot and binding assembly, said assembly comprising:

a boot having an axial immobilization element extending transversely in an intermediate zone between front and rear ends of said boot, said boot having a sole with an outer contour; and a binding, said binding comprising a device for automatic binding of a sporting item to said axial immobilization element of said boot, one of said ends of said boot being free to move toward and away from the sporting item, said device comprising:

a binding body adapted to be secured to the sporting item;

a latch mounted on said binding body for selectively securing or releasing said boot with respect to the sporting item, said latch being mounted for movement on said binding body between a latching position, whereby the axial immobilization element of said boot is to be latched to said binding body, while allowing the predetermined movement of said boot, and an unlatching position, whereby the axial immobilization element of said boot is released from said binding body; and a control mechanism arranged on said binding body to control said movement of said latch between said latching position and said unlatching position, said control mechanism comprising a knuckle joint system, said knuckle joint system being positioned, with respect to said binding body, for engagement with one of said ends of said boot for moving said latch to said latching position;

said control mechanism further comprising a control member connected to said knuckle joint system for movement of said latch to said unlatching position, said control member extending beyond the outer contour of the sole of the boot.

14. An assembly according to claim 13, wherein:

a transversely extending notch is formed for receiving said immobilization element in said latching position of said latch, said notch being demarcated at least in part by a portion of said binding body, said notch being located with respect to said binding body to receive said immobilization element with said immobilization element being located on a sole of said boot in a zone corresponding to the metatarsal bones of a foot inserted within said boot.

15. An assembly according to claim 13, wherein:

an elastic return member is located in a position adapted to be below the front end of said boot and said binding body, forward of said immobilization element of said boot, to urge the rear end of said boot toward the sporting item in opposition to movement of said boot away from the sporting item.

16. An assembly according to claim 13, wherein:

a transversely extending notch is formed for receiving said immobilization element in said latching position of said latch, said notch being demarcated at least in part by a portion of said binding body;

said latch is formed by a free end of a longitudinally movable element mounted for longitudinal movement with respect to said binding body and adapted for longitudinal movement with respect to the sporting item for cooperation with said notch for receiving and latching said immobilization element of said boot;

said knuckle joint system comprises two longitudinally extending connecting rods journalled together at respective ends of said connecting rods, constituting an intermediate point of said knuckle joint system, said connecting rods having respective remote ends;

one of said remote ends of said connecting rods is fixedly journalled with respect to said binding body, by means of a journal connection, and adapted to be fixedly journalled with respect to the sporting item in a zone corresponding to one of the ends of said boot;

another of said remote ends of said connecting rods is journalled to said longitudinally movable element, by means of a journal connection, whereby movement of said intermediate point of said knuckle joint from a position above a neutral equilibrium line passing through said journals of said remote ends of said connecting rods to a position below the neutral equilibrium line moves said latch to said latching position.

17. An assembly according to claim 16, wherein:

said intermediate point of said knuckle joint is located below a heel of a sole of said boot, whereby said movement of said intermediate point of said knuckle joint from a position above the neutral equilibrium line to a position below the neutral equilibrium line to move said latch to said latching position is caused automatically upon a lowering of the heel of said boot onto said intermediate point of said knuckle joint.

18. An assembly according to claim 16, wherein:

said binding body includes a longitudinally extending housing;

said longitudinally movable element forming said latch is constituted by a tie rod slidably mounted within said housing of said binding body, said tie rod being connected to one of said remote ends of said connecting rods of said knuckle joint system.

19. An assembly according to claim 16, wherein:

said journal connection between a remote end of one of said connecting rods and said longitudinally movable element comprises a slot provided in a rear of said longitudinally movable element;

a transversely extending journal rod, connected to said one of connecting rods, extends through said slot;

an elastic member is interposed between said journal rod and a shoulder of said rear of said longitudinally movable element for allowing a backward movement of said latch beyond a predetermined extent to ensure an automatic unlatching.

20. An assembly according to claim 16, wherein:

said free end of said longitudinally movable element forming said latch is constituted by an upwardly curved portion to demarcate, with said notch of said binding body, a housing that receives and latches said immobilization element in said latching position of said latch and that allows release of said immobilization element in said unlatching position of said latch.

21. An assembly according to claim 16, wherein:

said journal connection between a remote end of one of said connecting rods and said longitudinally movable element is located below a front end of a sole of said boot, whereby said movement of said intermediate point of said knuckle joint from a position above the neutral equilibrium line to a position below the neutral equilibrium line to move said latch to said latching position is caused automatically by a force exerted by the front end of the sole of said boot to said journal connection below the front of the sole of said boot.

22. An assembly according to claim 16, wherein:

said longitudinally movable element comprises two laterally opposed cheeks arranged on opposite sides of an end of one of said connecting rods, each of said cheeks including a respective guiding slot aligned opposite the other cheek and constituting a mounting of said journal connection between a remote end of one of said connecting rods and said binding body.

23. An assembly according to claim 22, wherein:

said two laterally opposed cheeks of said longitudinally movable element is constituted by an upwardly curved portion forming said latch to demarcate, with said notch of said binding body, a housing that receives and latches said immobilization element in said latching position of said latch and that allows release of said immobilization element in said unlatching position of said latch.

24. A boot and binding assembly, said assembly comprising:

a boot having an axial immobilization element extending transversely in an intermediate zone between front and rear ends of said boot; and a binding, said binding comprising a device for automatic binding of a sporting item to said axial immobilization element of said boot, one of said ends of said boot being free to move toward and away from the sporting item, said device comprising:

a binding body adapted to be secured to the sporting item;

a latch mounted on said binding body for selectively securing or releasing said boot with respect to the sporting item, said latch being mounted for movement on said binding body between a latching position, whereby the axial immobilization element of said boot is latched to said binding body, while allowing the predetermined movement of said boot, and an unlatching position, whereby the axial immobilization element of said boot is released from said binding body; and a control mechanism arranged on said binding body to control said movement of said latch between said latching position and said unlatching position, said control mechanism comprising a knuckle joint system, said knuckle joint system being positioned, with respect to said binding body, for engagement with one of said ends of said boot for moving said latch to said latching position;

a transversely extending notch being formed for receiving said immobilization element in said latching position of said latch, said notch being demarcated at least in part by a portion of said binding body;

said latch being formed by a free end of a longitudinally movable element mounted for longitudinal movement with respect to said binding body and adapted for longitudinal movement with respect to the sporting item for cooperation with said notch for receiving and latching said immobilization element of said boot;

said knuckle joint system comprising two longitudinally extending connecting rods journalled together at respective ends of said connecting rods, constituting an intermediate point of said knuckle joint system, said connecting rods having respective remote ends;

one of said remote ends of said connecting rods being fixedly journalled with respect to said binding body, by means of a journal connection, and adapted to be fixedly journalled with respect to the sporting item in a zone corresponding to one of the ends of said boot;

another of said remote ends of said connecting rods being journalled to said longitudinally movable element, by means of a journal connection, whereby movement of said intermediate point of said knuckle joint from a position above a neutral equilibrium line passing through said journals of said remote ends of said connecting rods to a position below the neutral equilibrium line moves said latch to said latching position;

one of said connecting rods fixedly journalled with respect to said binding body extending beyond said journal connection by a control lever extending beyond one of the ends of said boot, whereby movement of said control lever moves said intermediate point of said knuckle joint from a position below the neutral equilibrium line passing through said journals of said remote ends of said connecting rods to a position above the neutral equilibrium line to move said latch to said unlatching position.

* * * * *